United States Patent [19]

Manley

[11] 3,972,808

[45] Aug. 3, 1976

[54] PNEUMATIC CLASSIFIER WITH PARTICLE REMOVAL SYSTEM

[75] Inventor: Russell E. Manley, Portage, Ind.

[73] Assignee: Manley Bros. of Indiana, Inc., Chesterton, Ind.

[22] Filed: Mar. 25, 1974

[21] Appl. No.: 454,428

[52] U.S. Cl. ..... 209/133; 209/144; 209/149; 55/461

[51] Int. Cl.[2] ..... B07B 4/02

[58] Field of Search ..... 209/135, 133, 144, 136, 209/137, 143, 146, 149; 55/344, 461, 459

[56] References Cited

UNITED STATES PATENTS

| | | | |
|---|---|---|---|
| 837,705 | 12/1906 | Morse | 35/459 |
| 1,389,394 | 8/1921 | Stoneback | 209/135 |
| 1,484,208 | 2/1924 | Davis | 209/143 X |
| 1,493,186 | 5/1924 | Bentham | 209/143 |
| 1,511,025 | 10/1924 | Christurn | 209/135 X |
| 1,680,243 | 8/1928 | Becker | 209/250 |
| 1,752,231 | 3/1930 | Clarkson | 55/459 X |
| 1,761,627 | 6/1930 | Hine | 209/144 |
| 1,890,070 | 12/1932 | Whiton | 55/344 X |
| 2,012,263 | 9/1952 | Slavick | 209/135 X |
| 2,087,645 | 7/1937 | Helmann | 209/144 |
| 2,368,699 | 2/1945 | Arnold | 55/459 X |
| 2,890,764 | 6/1959 | Arnold | 209/144 X |
| 2,929,112 | 3/1960 | Massey | 55/461 X |
| 2,999,593 | 9/1961 | Stern | 209/144 |
| 3,180,492 | 4/1965 | Vandenhoeck | 209/133 |
| 3,288,284 | 11/1966 | Manley | 209/135 |
| 3,415,373 | 12/1968 | Pink | 209/137 |
| 3,426,893 | 2/1969 | Stark | 209/135 X |
| 3,682,302 | 8/1972 | Bernutat | 209/144 X |
| 3,734,287 | 5/1973 | Jager | 209/144 X |

FOREIGN PATENTS OR APPLICATIONS

| | | | |
|---|---|---|---|
| 376,555 | 7/1932 | United Kingdom | 209/144 |
| 667,142 | 2/1952 | United Kingdom | 55/344 |

*Primary Examiner*—Robert Halper
*Attorney, Agent, or Firm*—Edward D. Gilhooly

[57] ABSTRACT

An apparatus for pneumatically classifying non-uniform materials such as mineral particles and mine run materials which contain sizes ranging from relatively course particles down to fine dust. The apparatus includes a closed housing wherein a controlled air flow rapidly and efficiently classifies large quantities of material which pass through various classifying stages. The housing is provided with a system to remove and collect fines or dust from the housing which are created during the classifying operation on many types of material. The removal and collection system functions to withdraw a portion of the flow circulating in the housing and through the operation of a precipitator removes fines for collection whereby particle free air is returned to the controlled flow without disturbance to the classifying process.

9 Claims, 10 Drawing Figures

52
44
51
50
55
54
53
55b
55a
58
3
50
44
40
54
43
60
61
5
63
64
41
33
31
30a
30
1
10a
10
6
23
12
11
14
14a
15
13a
24
20
16a
13b
25
20
16b
13c
16c
20
13d
21
20
16d
2
2a
2b
34
36
17
42
41
43

Fig. 4
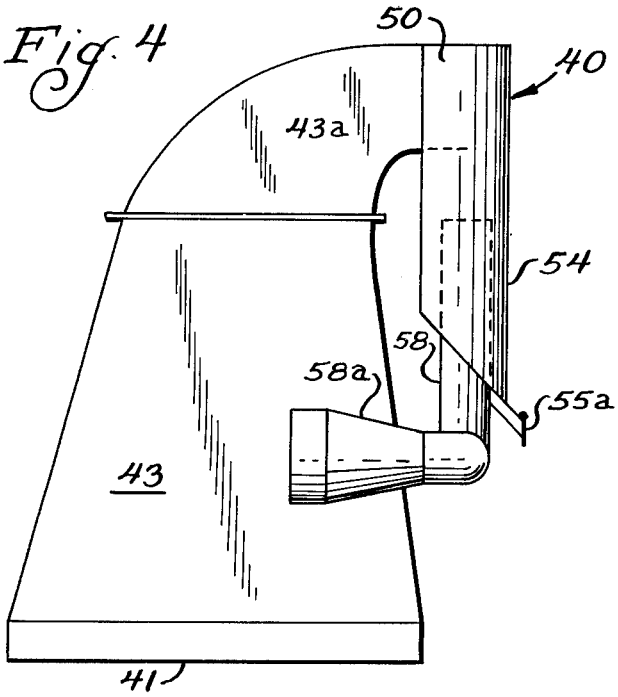
Fig. 5
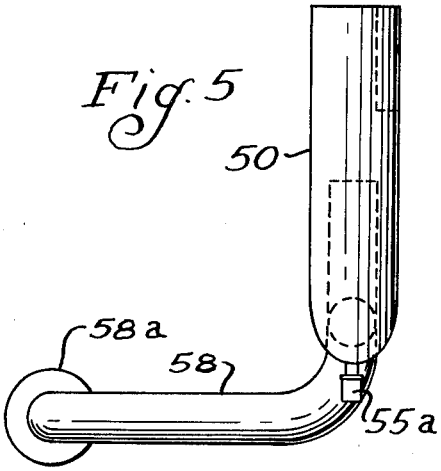
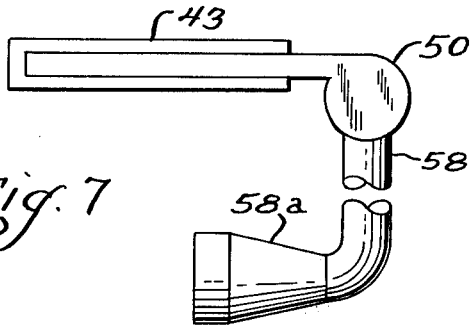
Fig. 7
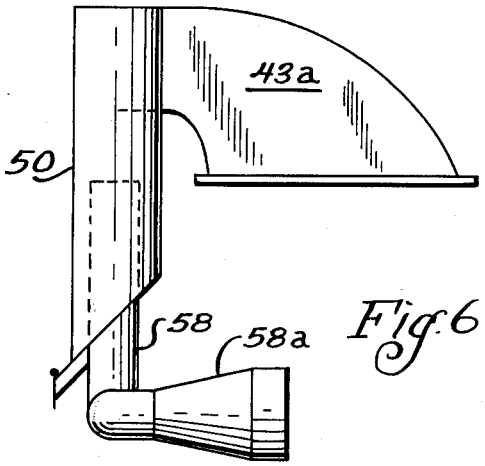
Fig. 6
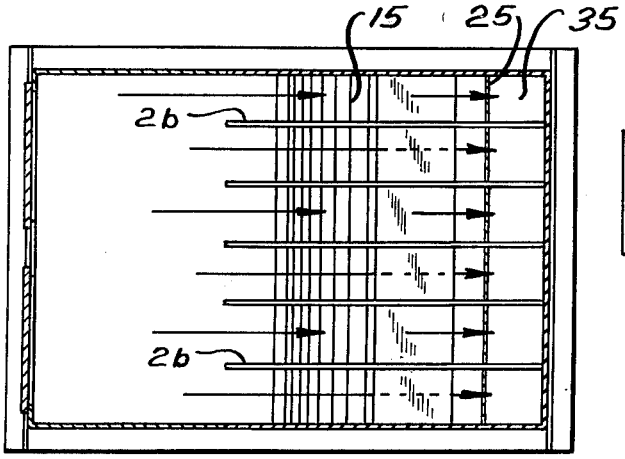
Fig. 3
Fig. 10
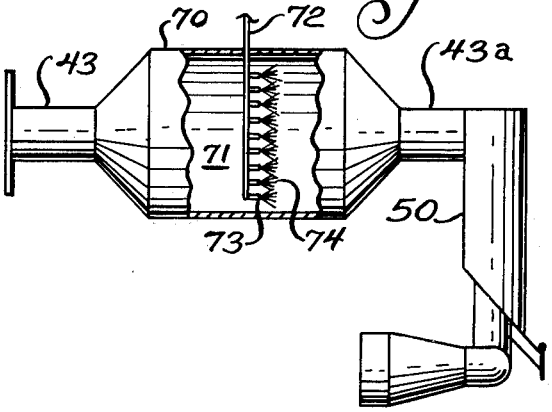

PNEUMATIC CLASSIFIER WITH PARTICLE REMOVAL SYSTEM

BACKGROUND OF THE INVENTION

The invention relates in general to a novel apparatus for classifying non-uniform particles and in particular, to a classifying apparatus including means to remove and collect fines or dust created during the classifying operation.

More specifically, the invention relates to an improved apparatus for pneumatically classifying mineral particles and mine run materials such as sand into a consistent particle size in separated fractions. The apparatus utilizes means to create a controlled flow of air through a series of classifying means to deflect free falling particles for separation according to size. The apparatus includes a fines removal and collection system to eliminate the presence of the very small or light particles which inherently form as a cloud of material within and in vicinity of a classifier during operation. The fines removal system includes means to extract the particles from the flow through the classifier to a precipitator for separation whereby the fines are collected and particle free air returns to the flow without disturbance to the classifying process.

In my prior patent, U.S. Pat. No. 3,288,284 for Method and Apparatus for Pneumatically Classifying Solids, issued Nov. 29, 1966, there is disclosed an improved system for classifying particles such as sand into separated fractions of highly uniform size. The apparatus disclosed in the patent is a significant improvement over the technique employed in the prior art and has accomplished highly effective results in use.

However, inherent in the pneumatic classification of many mineral particles and mine run materials such as by the apparatus of my prior patent is the formation of clouds of very fine material or dust which is referred to in the art as "fines". This phenomenon is created due to numerous conditions such as, for example, the physical properties of the material to be classified, the weight, density, and size of the smaller particles in the mass or deflection or bounce occurring during classification. Because a flow of pneumatic air is utilized to fractionize the particles according to size, the fines tend to laden the air stream passing through the classifying stages. Not only does the presence of fines or dust within the air stream interfere with accuracy of the classifying process, particularly after an extended operation, the material itself tends to clog up baffle plates which are used to maintain laminar flow through the apparatus and to thereby necessitate cleaning.

In addition to interfering with the operation of the classifier, the fines or dust also tend to escape from the apparatus to pollute the air of the surroundings as well as depositing material in the vicinity. Another problem associated with the previous systems for pneumatically classifying resulted because the prior system described in the patent and other apparatus are not in a closed system and are thus subject to atmospheric conditions around the apparatus. Because the apparatus often is situated out of doors, the presence of wind and other weather conditions can disturb the air flow circulating through the classifier and disrupt the accurate classifying of particles.

Accordingly, it is desirable to provide a classifier which achieves the highly efficient classification of solids as was possible in the apparatus of my prior patent within a closed system with removal of fines and dust in order that accurate classifying can be achieved during extended periods of service without pollution of the surroundings.

SUMMARY OF THE INVENTION

It is therefore, an object of the invention to improve the classifying of solid particles of varying sizes into fractions of uniform sizes.

A further object of the invention is to pneumatically classify solids of various sizes with a system which prevents pollution of the surroundings.

A still further object of the invention is to remove fines from a classifier without affecting the accuracy of the classifying operation.

Still another object of the invention is to remove fines for collection from an air stream by centrifugally separating pneumatic material from the air stream.

These and other objects are attained in accordance with the invention wherein there is provided an improved apparatus for pneumatically classifying solid particles into fractions of substantially uniform distribution. The apparatus is provided with means to remove and collect fines or small particles which inherently form as clouds adjacent a falling stream of solid material such as sand during classification. The apparatus of the invention accomplishes the removal of fines from the sealed environment of the machine without disturbing the velocity and direction of the air flow which is utilized to effect classification of the material. The technique of the invention removes the particles from the apparatus by extracting only a small portion of the air flow laden with fines circulating in the machine. However, because of the novel design of the apparatus disclosed herein, it is capable of extracting a substantial amount of the fines formed in the classifier.

As a result of the efficient removal of dust-like material, the improved classifying technique of my prior patent can be practiced within a closed system without causing pollution problems to the surrounding areas and without being affected by wind conditions to disturb the accuracy of the classifier. The fines are directed during operation of the apparatus to a precipitating device which centrifugally separates the fines from the flowing air stream after which the air stream is introduced back into the machine with minimal disturbance to the classifying air flow. The fines having been extracted are easily removed for collection as desired without the frequent replacement of elements which cause shutdown of the classifier.

BRIEF DESCRIPTION OF THE DRAWINGS

Further object of the invention together with additional features contributing thereto and advantages accruing therefrom will be apparent from the following description of several embodiments of the invention when read in conjunction with the accompanying drawings wherein:

FIG. 3 is a top cross-sectional illustration taken along lines 3 — 3 of FIG. 1;

FIG. 4 is a partial front schematic illustration of one embodiment of the fines removing and collector precipitator system of the classifier of FIG. 1;

FIG. 5 is an end schematic illustration of the system of FIG. 4;

FIG. 6 is a back schematic illustration of the system of FIG. 4;

FIG. 7 is a front perspective illustration of the system of FIG. 4;

FIG. 10 is an end schematic illustration with parts in section of a second embodiment of the fines removal and collection system of the invention for use in the classifier of FIG. 1.

DESCRIPTION OF THE PREFERRED EMBODIMENTS

Figures 1, 8, 9:
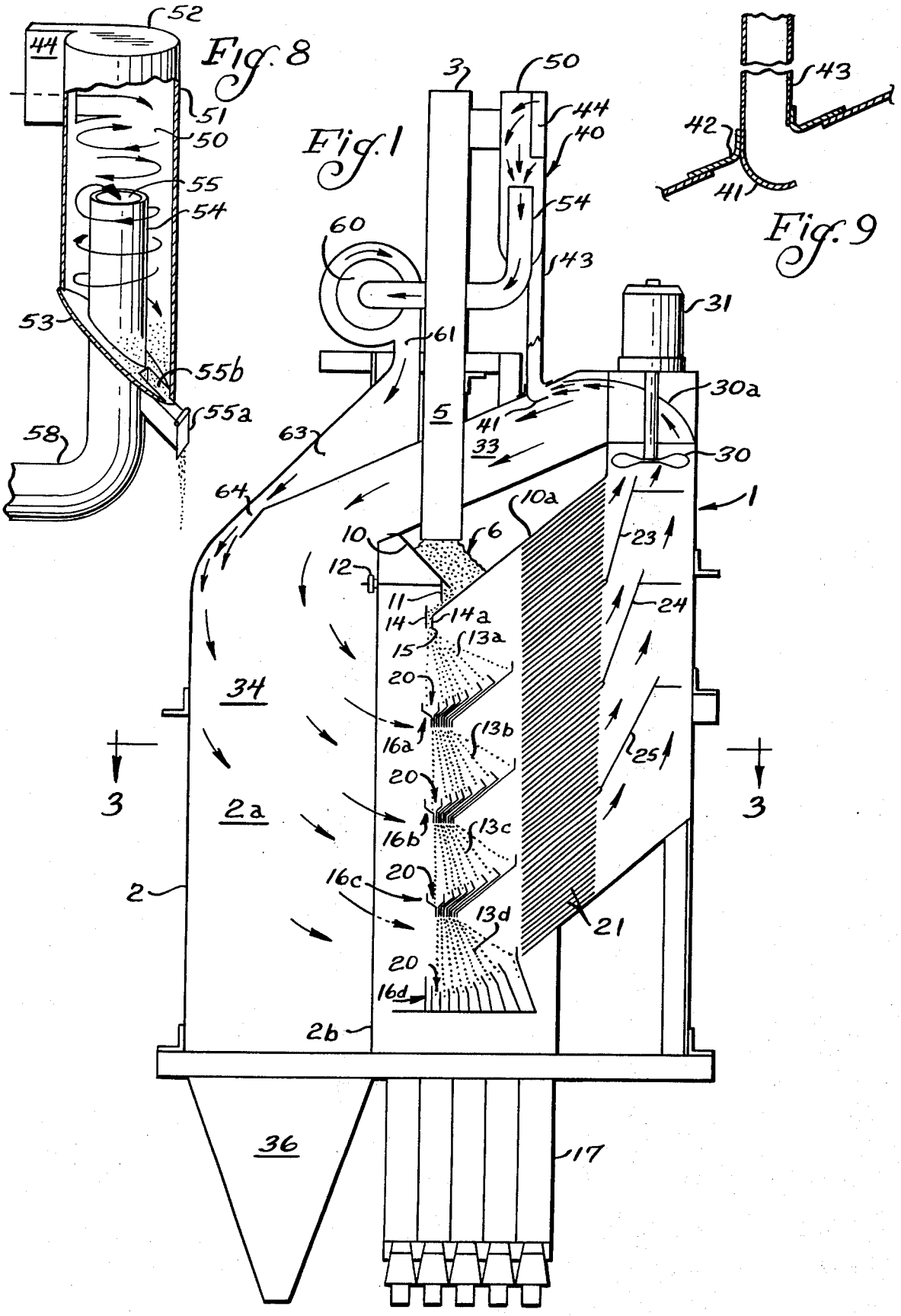
FIG. 1 is an end schematic illustration with parts removed of the pneumatic classifier of the invention.
FIG. 8 is an enlarged perspective illustration with parts in section of the system of FIG. 4.
FIG. 9 is an enlarged end sectional illustration of the cut gate of the system of FIG. 4.
Figure 2:
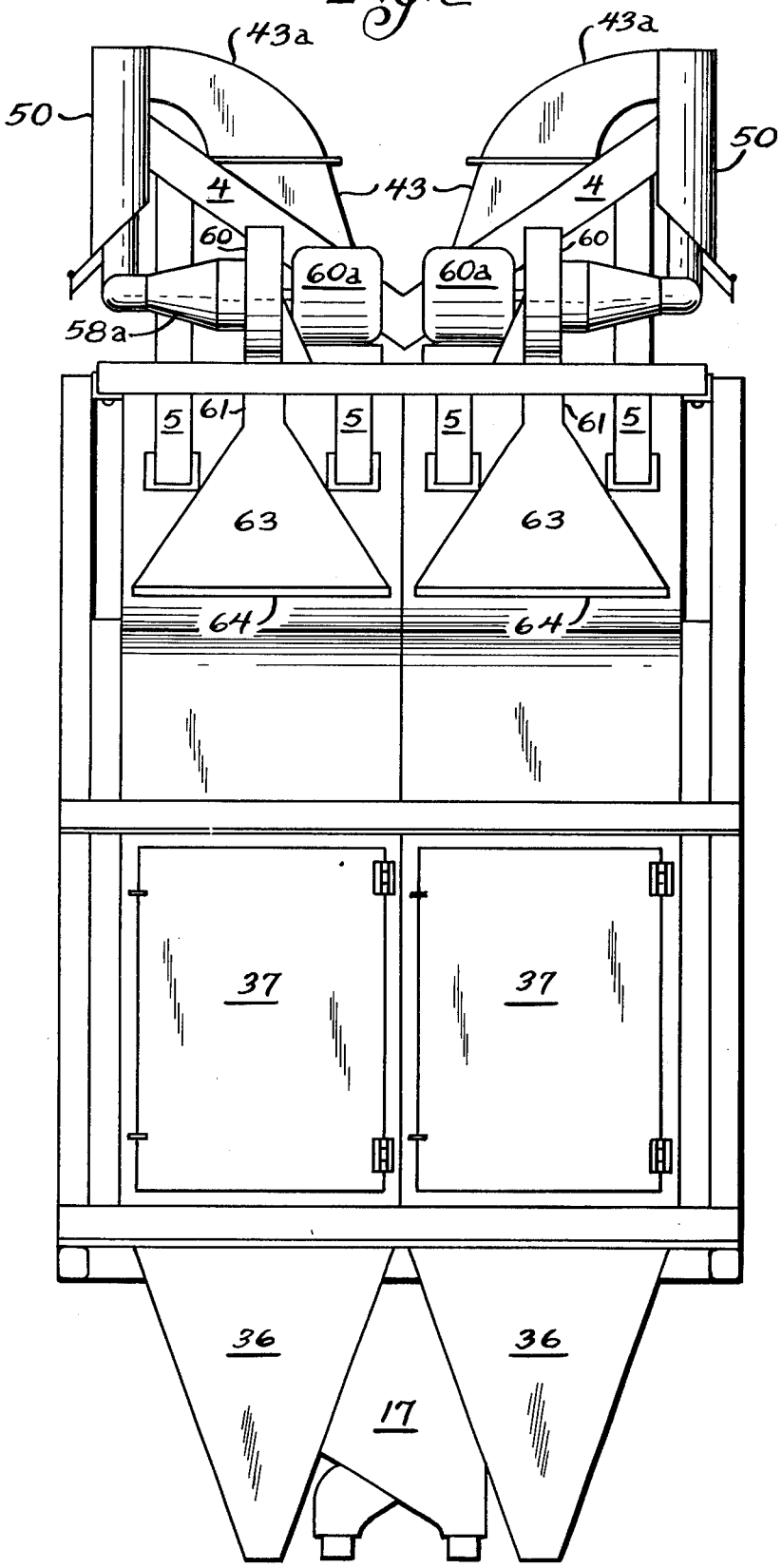
FIG. 2 is a front schematic illustration of the pneumatic classifier of FIG. 1.

Referring to FIGS. 1 to 8 there is illustrated one embodiment of the improved apparatus of the invention for pneumatically classifying solids with removal of fines created during operation. The classifier apparatus 1 of the invention includes a housing 2 as shown in FIGS. 1 and 2 which is supported by any suitable structure (not shown). Housing 2 possesses four vertical exterior walls, a top and a bottom floor to form a classifying chamber 2*a* capable of being sealed from the exterior. Classifier 1 functions to classify solids with a substantially similar operation to that disclosed in my prior U.S. Pat. No. 3,288,284. Essentially, the housing receives a supply of material to be classified in the form of mineral particles or mine run materials such as sand which contain particles ranging in size from relatively course particles down to fine dust. The material is introduced into classifier 1 through a feed duct 3 which may be coupled to any suitable supply means such as a hopper and the like (not shown). The material thus introduced into the classifier is distributed from feed 3 through a duct 4 to selectively enter a plurality of vertically mounted delivery chutes 5.

Each of the delivery chutes 5 drops a stream of particles for entry into a series of classifying cells 6 which function through successive stages to separate particles into a plurality of separated fractions of uniform particle size as will be explained later. Each of cells 6 includes a respective delivery chute 5 and are separated within housing 2 by walls 2*b* to form classifying chambers. Although the classifier of the invention is illustrated with a bank of six individual cells as best shown in FIG. 3, it is within the scope of the invention to utilize other number of cells or a plurality of banks with a number of cells depending on desired results and encountered conditions.

In the following description the general operation of the classifying process of classifier 1 will be explained. However, for a more detailed description of the function and structure of the classifier with respect to the classifying operation, specific reference is made to my prior U.S. Pat. No. 3,288,284 in which the classifying process is described in detail.

Each of the classifying cells 6 are constructed identically and receive through delivery pipe 5 the freely flowing particles delivered from feed 3. During operation of the cells, it is possible, if desired, to selectively activate one or all of the cells as desired. The material delivered from delivery chute 5 collects in a pile of material on the bottom walls 10 and 10*a* mounted in angular relationship beneath the delivery chute. Material is discharged from the feed hopper at a controlled rate by means of gate 11 pivotally mounted on front bottom wall 10. An adjusting knob and rod assembly 12 is suitably mounted on the housing and is operative to move the gate pivotally to or from the rear bottom wall 10*a*. When the gate is swung forward, a stream of particles flows on the rear bottom wall 10*a* and since the bottom wall is at an angle close to the angle of repose, the material rolls down the inclined plane rather than sliding.

The granular material is pneumatically classified similarly in each of four successive stages of each cell in air chambers 13*a*, 13*b*, 13*c* and 13*d*. In the first stage, the material is stopped by a bumper plate 14 and is reduced to almost zero velocity. The material then falls by gravity through slot 15 into the upper most air chamber 13*a*. A stream or current of air is passed through each of the chambers (by means to be described in detail later) in direction transverse to the stream of falling particles as represented by arrows in FIG. 1.

The air stream causes the particle stream to fan out rearwardly according to the physical characteristics of the material, while the particles continue to fall, the distribution is a function of density and/or surface characteristics and/or terminal velocities of the particles. The largest and heaviest particles are affected the least by the air stream, and the lightest classifiable materials are affected the most, with the intermediate densities and sizes falling therebetween. It should be apparent that during this operation that some of the very small particles or ones having low density, weight or size are carried away by the air stream or deflected upward from the classifying structure to form a cloud of dust or fines.

The pneumatically classified particles are collected in the individual cells by an assembly of successive collectors 16*a*, 16*b*, 16*c*, and 16*d*. After passing through the first stage 13*a*, the material continues to drop in a more separated form into successive stages 13*b*, 13*c* and 13*d* during which time the size of particles in each separated fraction are made more uniform to a greater degree. During the passage through each of the stages, the air flow deflecting the particles remains constant and non-turbulent. The material deflected in the first stage 13*a* are collected in their approximate separated size in a plurality of collectors 20 which allow them to fall into the successive stages. The bottom collectors 20*a* will collect the finally classified in their separated fractions and deliver the collected material to a fractional discharge 17 by means not shown.

After passing through the classifying chambers, the air flow is directed through metallic baffles 21 which are utilized to insure laminar flow through the apparatus. After passing through the baffles 21, the flow moves upward in housing under the control of pivotally mounted dampers 23, 24 and 25. Each of the cells created by walls 2*b* includes a fan 30 driven by a suitable motor 31 to create a controlled flow circulating in chamber 2*a* as indicated by arrows in FIG. 1. The flow from fan 30 is directed against a curved surface 30*a* after which the air current moves in the upper portion 33 of housing into front area 34 of housing 2. It should be noted that upper portion 33 and front area 34 are not divided into a series of chambers by vertical walls 2*b*.

Housing 2 is also provided with a conventional collector 36 at the bottom thereof to collect any particles which have been diverted from the classifying chambers and any heavier fines which have precipitated out of the air flow.

As has been discussed previously, the passing of the controlled air flow through the free falling particles to be classified creates a cloud of very fine material known as fines which are capable of interfering with the accuracy of the classifier because of a buildup of material in baffle plates 21 or disturbance of the circulating flow of air within the system, or causing pollution of the surroundings of the machine. Accordingly, the classifier of the invention includes a fines removal system which extracts the air flow laden with fines or small material, removes and collects the particles therefrom and returns the air into the circulating flow without disturbance.

Curved wall 30*a* performs not only the function of aiding circulation of the controlled flow through the housing in a manner outlined by the arrows in FIG. 1, but through centrifugal force the fines or dust particles in the air tends to concentrate against the wall in flowing relationship thereto. As the fines move along wall 30*a* in the upper portion 33 of the housing, the material is introduced into fines removal system means 40. The material enters system 40 through a cut gate 41 having a curved surface which extends within the flow of the air in upper portion 33 and forms an opening corresponding to the heaviest concentration of fines flowing in the stream. For efficiency of operation it has been found that it is desirable that the width of cut gate 41 extends over a plurality of cells, such as three as shown in the drawings. However, it should be apparent to one skilled in the art that the cut gate 41 can extend the width of one or any number of cells as desired.

Cut gate 41 is supported on the housing by means of a pair of flanges 42 and is integrally coupled to an inlet duct 43 which gradually tapers in cross-sectional area for attachment to a precipitator inlet duct 43*a*. In turn, precipitator inlet duct 43*a* is coupled to a precipitator inlet 44 to create a circular flow within a precipitator 50.

Precipitator 50 comprises a vertically oriented cylindrical-like member 51 having a closed upper top 52 and a slanting bottom 53 adapted to collect particles which have been removed by action of the precipitator as best illustrated in FIGS. 8 and 9. The flow laden with particles enters inlet 44 and because of the orientation of the inlet relative to the cylinder causes a swirling or rotational flow within the precipitator along sidewall in a downward direction as shown by the arrows in FIG. 8. The fines and dust material in the air flow are impinged in a circulatory motion by centrifugal force against the walls of the precipitator and are carried by the air flow down beneath the top of a vertically oriented air removal pipe 54 which extends into precipitator 50.

Air removal pipe 54 is in the form of a hollow conduit having an upper outlet 55 which is coupled to a negative source of pressure to extract air from the circulating air. The heavier particles in the form of fines and dust drop through gravity along the sides of the precipitator and are not carried in the air flow egressing through pipe 54. The deposited material generally collects at the lowermost portion of bottom 53 of the precipitator as illustrated in FIG. 8. The collected material may be selectively removed through a fines collection outlet 55*b* having a conventional gate 55*a* which normally remains closed during operation of the system.

The air free of particles flowing through pipe 54 enters an integrally coupled outlet duct 58 having a suitable bend of 90° or the like. The end portion 58*a* of the duct expands to be coupled to a conventional blower that creates the negative pressure level within the fines removal system. Blower 60 comprises any conventional blower or fan and is driven by an electric motor 60*a*. The flow of air from blower 60 is directed to a blower exit pipe 61 which is in fluid connection with a hood 63 as best shown in FIGS. 1 and 2. Hood 63 includes an angularly disposed portion 64 to direct the air flow from the system back into the classifier in front area 34 of the housing. Hood 63 terminates with a width substantially equal to the width of three cells and to the width of cut gate 41. The flow rate created by blower 60 and the configuration of the conduits and ducts of fines removal system 40 is selected to cause minimal disturbance to the air flow created by fans 30 in housing 2 in order to insure accurate classifying results.

Referring now to FIG. 10 there is illustrated another embodiment of the fines removal system of the invention. The embodiment of FIG. 10 is adapted to be coupled to the classifier 1 and functions in a similar manner to that as shown in the preceeding embodiment. However, as an aid in removing material from the particle laden air flowing through cut gate 41, the embodiment of FIG. 10 includes means to add a spray of moisture to the stream to effectively remove particles and odor in the precipitator. Droplets of moisture are added to the particle laden flow in removal system 40 through a fluid injecting means 70 imposed in duct 43. The inlet flow from duct 43 into means 70 is expanded within a chamber 71 of the fluid injecting means 70. Moisture in the form of a fine spray or droplets of water or other liquid is introduced into the flowing stream by means of a fluid pipe connected to a suitable source of fluid and having a plurality of nozzles 73. Nozzles 73 deliver a fine mist of liquid to the air stream whereby the size of the particles of liquid are generally larger than the size of the dust or fines contained in the flow from the classifier. The flow of air having both fines and water droplets are introduced into the precipitator in the same manner as the preceeding embodiment by duct 43*a*.

In the preceeding embodiment the circulating flow created in precipitator 50 caused the fines to impinge against the wall thereof in a circulatory pattern. It has been found that the addition of droplets of water acts to entrap the solid particles against the cylinder while maintaining a similar motion. The larger droplets of liquid tend to flatten themselves against the sides of the precipitator because of centrifugal force and the dust material are maintained away from the central portions of the precipitator to prevent any escape of them through outlet 54. Moreover, the relative heavy weight of the liquid carries the particles effectively downward for removal at fines collection outlet 53. Thus, the action of the droplets of liquid on the fines within the precipitator acts to capture them in a very efficient manner whereby the air flow can readily be returned into the classifier in a manner previously described with reference to the embodiment of FIGS. 1 to 9.

In the above description there has been disclosed an improved apparatus for classifying particles having a system to remove fines in the form of a cloud of material which is inherently created during classification of many solid particles. Although the fines removal system described in the invention utilizes a precipitator for centrifugally removing particles, it is within the scope of the invention to utilize other particle removing techniques for separating the particles from the flow such as other centrifugal means, precipitators and filtering systems. Moreover, the particle removal system can be positioned wholly within the housing of the classifier or can be exteriorly mounted as desired to accomplish the improved results of the invention. Although for convenience of illustration, particle removal system 40 was described in use with a classifier similar to the one disclosed in my prior U.S. Pat. No. 3,288,284, the system can also be utilized with other classifying techniques or environments other than the area of classifiers in which the formation of clouds of particles is encountered.

While the invention is described with reference to preferred embodiments, it will be understood by those skilled in the art that various changes be made and equivalents may be substituted for elements thereof without departing from the scope of the invention. In addition, many modifications may be made to adapt a particular situation or material to the teachings of the invention without departing from its essential teachings. Therefore, it is intended that this invention not be limited to the particular embodiment disclosed as the best mode contemplated for carrying out this invention, but that the invention will include all embodiments falling within the scope of the appended claims.

What is claimed is:

1. A pneumatic classifier comprising:

feed means for creating a stream of solid material having particles of varying sizes;

classifying means responsive to air flow for receiving said stream to classify the particles into fractions containing substantially uniform sizes;

air flow means operatively coupled to the classifying means to create a controlled air flow for contacting the stream to effect classification of a substantial portion of the particles into fractions;

particle collection means operatively mounted adjacent the classifying means to collect unclassified particles of the stream other than said substantial portion which unclassified particles remain in said controlled air flow after passing through the classifying means;

said particle collection means including particle removal means in fluid communication with an inlet means and an outlet means, said inlet means being mounted adjacent said controlled air flow means for extracting a portion of the controlled air flow having unclassified particles to be collected and said outlet means mounted downstream of said particle removal means for returning particle free air to the controlled air flow without disturbance thereto;

said particle removal means including means for creating a secondary air flow between said inlet means and said outlet means; and housing means for confining the controlled air flow created by said air flow means into a confined circulating flow through said classifying means, said inlet means and said outlet means extending substantially the width of the controlled air flow in said housing means.

2. A pneumatic classifier as claimed in claim 1, wherein said outlet means includes a hood having an angularly disposed portion to direct the particle free air back into the classifying means.

3. A pneumatic classifier comprising:

feed means for creating a stream of solid material having particles of varying sizes;

classifying means responsive to air flow for receiving said stream to classify the particles into fractions containing substantially uniform sizes;

air flow means operatively coupled to the classifying means to create a controlled air flow for contacting the stream to effect classification of a substantial portion of the particles into fractions;

particle collection means operatively mounted adjacent the classifying means to collect unclassified particles of the stream other than said substantial portion which unclassified particles remain in said controlled air flow after passing through the classifying means;

said particle collection means including particle removal means having inlet means for extracting a portion of the controlled air flow having unclassified particles to be collected and outlet means for returning particle free air to the controlled air flow without disturbance thereto;

said particle removal means including means for creating a secondary air flow between inlet means and said outlet means;

housing means for confining the controlled air flow created by said air flow means into a confined circulating flow through said classifying means; and said housing means including a housing having an upper portion and a curved wall disposed in the upper portion to concentrate the unclassified particles thereto, said inlet means including a cut gate having a curved surface extending within the controlled air flow in the upper portion of the housing.

4. The classifier of claim 3 wherein said air flow deflects the particles on contact to classify the particles in fractions containing substantially uniform sizes.

5. The classifier of claim 4 wherein said feed means creates a stream of freely falling solid material.

6. The classifier of claim 1 in which the particle removal means induces swirling flow within a chamber having a cylindrical inner wall.

7. The classifier of claim 6 wherein the air flow laden with a mass of unclassified material enters the chamber adjacent one end thereof and further including means mounted adjacent the opposite end to receive the mass separated from the air flow.

8. The classifier of claim 7 further including outlet means extending within the chamber to receive air flow having the mass of unclassified material separated therefrom.

9. The classifier of claim 8 wherein said unclassified material collects beneath said outlet.

* * * * *